US005185630A

United States Patent [19]

Nagasawa et al.

[11] Patent Number: 5,185,630

[45] Date of Patent: Feb. 9, 1993

[54] COPYING MACHINE HAVING TOP WALL WITH SLIT FOR CLEANING ACCESS

[75] Inventors: Tamami Nagasawa, Osaka; Masayuki Ida, Nara, both of Japan

[73] Assignee: Sharp Kabushiki Kaisha, Osaka, Japan

[21] Appl. No.: 824,896

[22] Filed: Jan. 21, 1992

Related U.S. Application Data

[63] Continuation of Ser. No. 356,003, May 23, 1989, abandoned.

[30] Foreign Application Priority Data

May 31, 1988 [JP] Japan ..... 63-135121
May 31, 1988 [JP] Japan ..... 63-135122

[51] Int. Cl.[5] ..... G03G 15/02; G03G 15/04

[52] U.S. Cl. ..... 355/215; 355/221; 355/234

[58] Field of Search ..... 355/1, 30, 215, 221, 355/230, 231, 264, 234, 200, 202; 361/230; 250/324; 206/338; 220/229, 256, 9.1

[56] References Cited

U.S. PATENT DOCUMENTS 3,061,080 10/1962 Stephen ..... 206/338
3,992,093 11/1976 Jakobson ..... 355/234 X
4,246,945 1/1981 Sterling ..... 220/9.1 X
4,566,777 1/1986 Honda et al. ..... 355/297
4,588,280 5/1986 Ogawa et al. ..... 355/200
4,788,573 11/1988 Nakaoka et al. ..... 355/215

FOREIGN PATENT DOCUMENTS 0187958 11/1983 Japan ..... 355/221
0239139 10/1987 Japan ..... 355/234

OTHER PUBLICATIONS

Tanjo et al., European Patent Application #267,689, May 1988.

*Primary Examiner*—Joan H. Pendegrass
*Assistant Examiner*—Robert Beatty
*Attorney, Agent, or Firm*—Morrison & Foerster

[57] ABSTRACT

A copying machine has a top wall with a slit which remains covered during a copying operation by a board for carrying an original to be copied. When the machine is not in use, the board can be moved so as to expose the slit. The slit is elongated transversely to the direction of motion of the board and a passage is provided under the top wall and through a reflector member such that a tubular cleaner member can be not only inserted through the slit to reach an internal component such as the charger wire which requires cleaning but also moved transversely along the slit. Thus, the internal component can be cleaned without removing the top wall.

13 Claims, 8 Drawing Sheets

COPYING MACHINE HAVING TOP WALL WITH SLIT FOR CLEANING ACCESS

This application is a continuation of application Ser. No. 07/356,003, filed May 23, 1989, now abandoned.

FIELD OF THE INVENTION

The present invention relates to a copying machine having an arrangement for the easy cleaning of, for example, a charging wire for a main charger from the outside of the machine.

BACKGROUND OF THE INVENTION

In an electrostatic copying machine, it is required that prior to the stage of exposing the surface of a photoreceptor to light, the surface of the photoreceptor be subjected to electrostatic charging. For this purpose, a main charger is placed near the photoreceptor. This main charger has a charge wire placed adjacent a photoconductive layer of the photoreceptor and made of a fine tungsten wire. As a high voltage is applied to the charge wire, corona from the charge wire makes airborne particles ionize and the ionized particles deposit on the surface of the photoreceptor to charge the surface thereof.

The aforementioned charge wire is liable to gather dust while the copying machine is in use, and the dust on the charge wire causes blurs or lines on a copied image. Therefore, it is necessary that the charge wire must be subjected to periodic cleaning.

The charge wire of the main charger is usually cleaned by opening a front casing member, taking out the main charger incorporated in the machine, and wiping the charge wire placed in the main charger.

However, any arrangement for opening the front casing member and taking out the main charger so as to clean the charge wire of the main charger is disadvantageous in that the construction of the copying machine is made complex and the copying machine is necessarily larger in size and heavier. This results in an increase in the manufacturing cost.

SUMMARY OF THE INVENTION

It is an object of the invention to provide a copying machine arrangement which enables easy cleaning of its components, such as a charge wire of a main charger, from outside the machine without opening a front casing member and taking out the main charger from the machine.

It is another object of the invention to provide an arrangement which prevents dust and the like from entering the copying machine through a slit in the casing member during copying operation or the like. When it is required to clean components of the machine, a cleaner is inserted into the machine from outside through an open gap of a passage for cleaner insertion so that the components of the machine can be cleaned only by externally controlling the cleaner.

It is another object of the invention to provide an arrangement which enables direct cleaning of components of the copying machine to thereby considerably reduce the number of components of the machine. This makes the machine compact, lightweight, and less expensive.

It is a further object of the invention to provide an arrangement which permits smooth cleaning operation with respect to interior components at much higher efficiency.

It is a still further object of the invention to provide an arrangement which makes it possible to considerably improve the operational efficiency and cleaning efficiency and which prevents light from an exposure lamp from leaking through the passage for cleaner insertion and also prevents the entry of stray light or the like from an external light source or the exposure lamp onto the photoreceptor drum in the machine. This permits good copying performance to be maintained.

It is another object of the invention to provide increased flexibility of design for a copying machine and minimize the clearance between a reflector and a main charger in order to contribute to the furtherance of size reduction, weight reduction, and cost reduction in the manufacture of copying machines.

It is another object of the invention to provide an arrangement which permits smooth cleaner operation for interior components without involving plastic deformation of a flexible sheet for shutting off the cleaner insertion passage.

In order to accomplish the foregoing objects, the present invention provides a copying machine comprising a casing member forming a top wall of the machine, this casing member having a slit for directing the light from an exposure lamp which is disposed under this casing member, toward an original setting board, and the original setting board being movable on the casing member for reciprocation in the right and left directions, characterized in that the movable range of the original setting board is defined so that the slit is covered by the original setting board irrespective of the position of the original setting board during its reciprocating movement on the casing member for copying operation, and in that the original setting board is movable beyond the movable range at least in one direction, either rightward or leftward, when it is not in copying operation, the limit for said movement in one direction of the original setting board being set so that an open gap is defined between an edge of the original setting board and an edge of the slit to provide a passage for cleaner insertion which leads to the interior of the machine, when the original setting board is moved beyond the movable range. Also, the edge of the original setting board and the edge of the slit are so formed as to serve as a guide for the cleaner during cleaning operation.

The foregoing arrangement eliminates the necessity of adapting the front casing member of the copying machine to be opened and closed and/or designing the main charger and the like to be detachable from the machine, for the purpose of cleaning the charge wire for the main charger incorporated in the machine. Therefore, the number of components of the copying machine can be considerably decreased, this being thus possible to further size reduction weight reduction, and cost reduction of copying machines. Further, according to the invention, interior members to be cleaned can be readily cleaned only by inserting a cleaner into the cleaner insertion passage through the open gap defined between the edge of the original setting board and the edge of the slit and operating the cleaner from the outside of the machine; thus, cleaner control and cleaning efficiency can be considerably improved.

In another copying machine of the invention, there is provided, on the cleaner insertion passage accessible from outside a machine, a flexible sheet having light shielding properties in such a way as to shut off the passage. The flexible sheet may consist of one sheet only, but preferably it consists of at least two sheets. When the flexible sheet having light shielding properties includes a plurality of sheets, they are individually disposed at an outer side and at an inner side of the machine, on the cleaner insertion passage accessible from outside the machine, in spaced apart and opposed relation, in such a way as to shut off the passage.

In still another copying machine in accordance with the invention, flexible sheets having light shielding properties are individually disposed at the outer side and at the inner side on the cleaner insertion passage accessible from outside the machine, in spaced apart and opposed relation, in such a way as to shut off the passage, and the flexible sheet disposed at the outer side has light reflecting properties so that it concurrently serves as a part of a reflector. The flexible sheet disposed at the inner side has electroconductive properties so that it concurrently serves as a part of a main charger case.

In still another copying machine according to the invention, flexible sheets having light shielding properties are individually disposed at an outer side and at an inner side on a cleaner insertion passage accessible from outside the machine, in spaced apart and opposed relation, in such a way as to shut off the passage, and the flexible sheet disposed at the outer side is formed with an inclined edge portion along a flexible sheet portion where the cleaner is inserted so as to enable a longitudinally extending edge portion of the sheet to upstand in the outward direction as the inserted cleaner moves in a lateral direction, while on the other hand the flexible sheet disposed at the inner side has a longitudinally extending edge portion of the sheet adapted to downstand in the inward direction as the inserted cleaner moves in the lateral direction.

Through above described arrangement, it is possible to achieve size reduction, weight reduction, and low cost production of copying machines. The arrangement makes it possible to clean interior components only by inserting a cleaner into the cleaner insertion passage from outside and externally controlling the cleaner, and therefore improved cleaner control and improved cleaning efficiency can be obtained. At the same time, stray light from the outside onto the photoreceptor drum in the machine can be prevented. Thus, good copying performance characteristics can be maintained. Furthermore, the clearance between the reflector and the main charger can be minimized and, in addition, the arrangement permits smooth cleaning operation with respect to the interior components without plastic deformation of the flexible sheets.

BRIEF DESCRIPTION OF THE DRAWINGS

FIG. 1 is a fragmentary schematic block diagram showing principal parts of the internal construction of a copying machine;

FIG. 2 is a schematic block diagram showing a condition of the copying machine when a charge wire for a main charger is being cleaned by a cleaner having its charger-cleaning front end portion inserted from outside into the interior of the machine;

FIGS. 3 through 5 are, respectively, explanatory views showing the movable range of an original setting board during copying operation;

FIG. 6 is an explanatory illustration showing the position of the original setting board which is set as the limit for its movement when interior components for cleaning are to be cleaned by external cleaning control while the board is not in copying operation;

FIG. 7 is a perspective view showing principal parts of a flexible sheet mounted on a reflector;

FIG. 8 is a fragmentary perspective view showing a condition of two flexible sheets mounted on the reflector when they are temporarily opened by a cleaner inserted;

FIG. 9 is a perspective view of a cleaner.

FIG. 10 is a fragmentary schematic block diagram showing principal parts of the internal construction of the copying machine; and FIG. 11 is a fragmentary schematic block diagram showing the condition of the copying machine when a charge wire for a main charger is being cleaned by a cleaner having its front end portion inserted from outside into the interior of the machine.

DESCRIPTION OF THE EMBODIMENTS

One embodiment of the invention is described below with reference to FIGS. 1 through 9.

Figure 1:
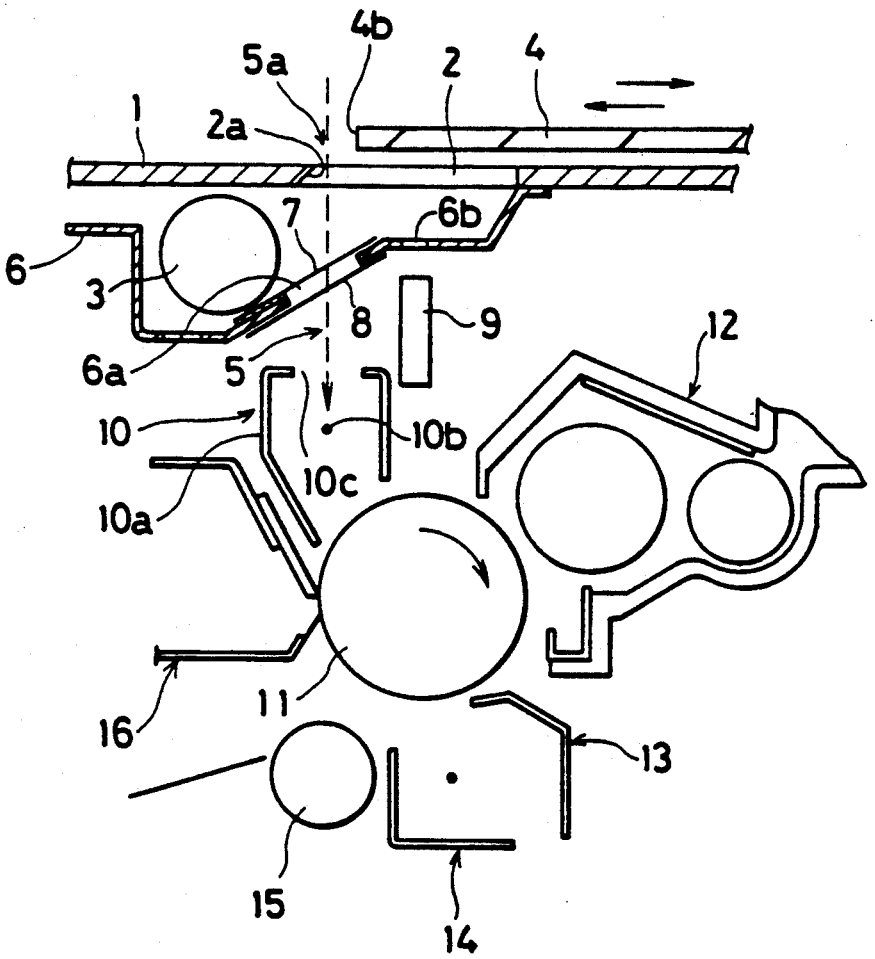
FIGS. 1 through 9 show an embodiment of the invention.
Figure 2:
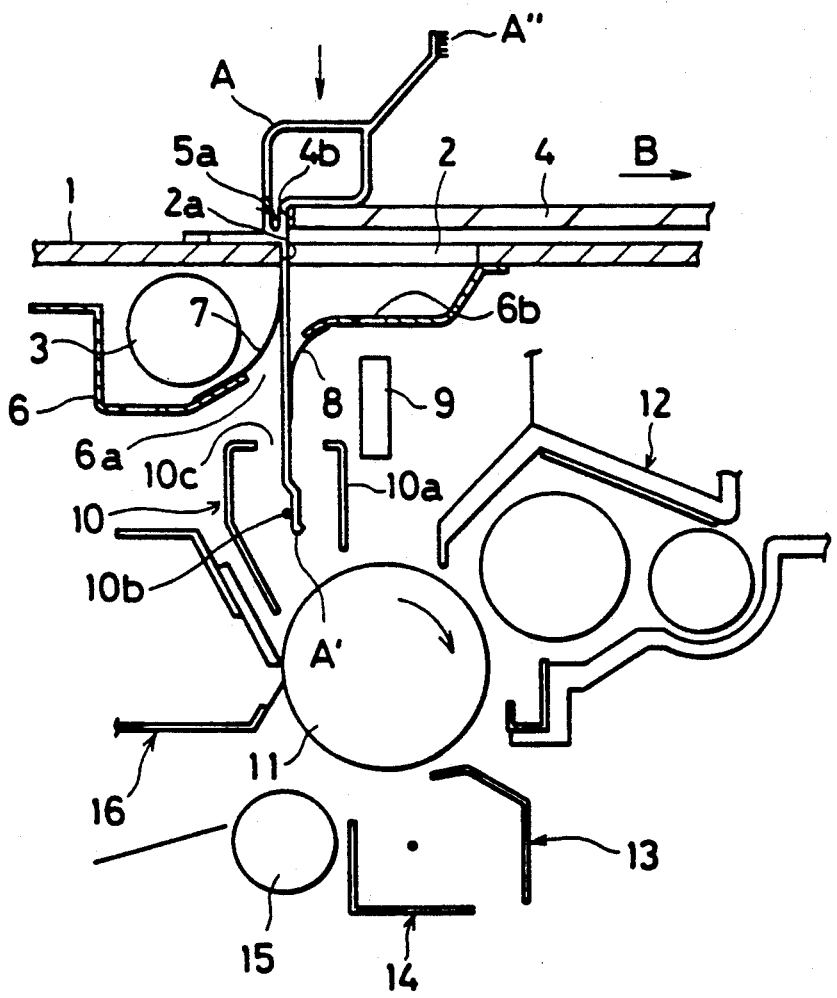

As shown in FIGS. 1 and 2, a casing member 1 which constitutes a top wall of a copying machine is formed with an elongate slit 2 having a predetermined width extending in a direction perpendicular to the direction of the movement of an original setting board 4 which is able to laterally move reciprocatingly on the casing member 1. Under the casing member 1 there is disposed an exposure lamp 3 so that light projected from the exposure lamp 3 is directed through the slit 2 toward the transparent original setting board 4 which is slidable on the casing member 1.

Figure 3:
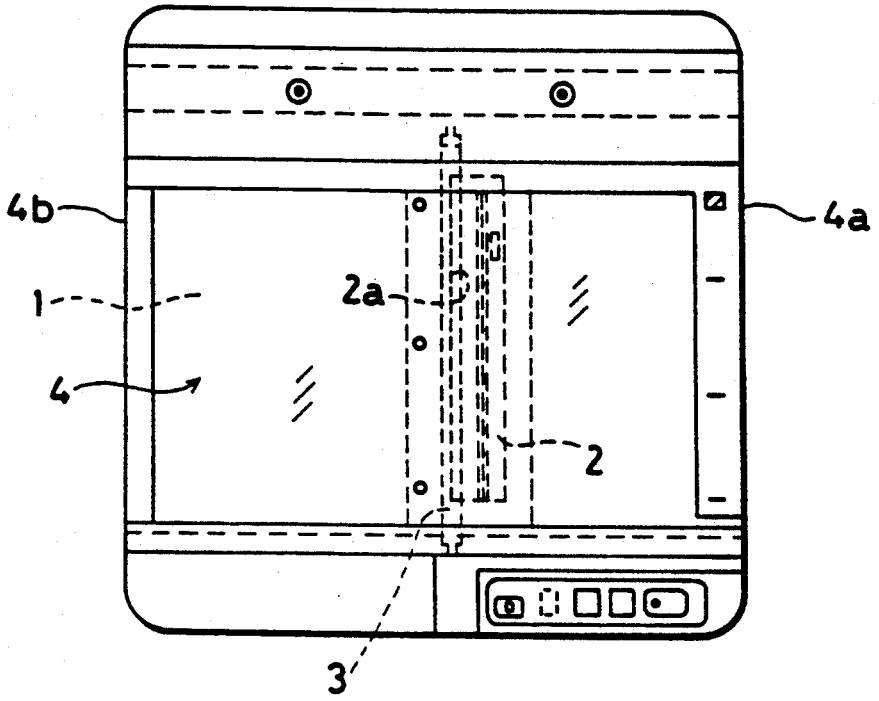

The aforementioned original setting board 4 on which an original is to be placed automatically and reciprocatingly moves laterally on the casing member 1 during a copying operation, and the aforementioned slit 2 is always covered by the original setting board 4 in this state irrespective of the position of the original setting board 4 during its movement for a copying operation. In other words, as shown in FIGS. 3 through 5, a moving range E of the original setting board 4 is defined so that the slit 2 in the casing member 1 is covered by the original setting board 4, even when the original setting board 4 is positioned at a right end or a left end of its moving range E during a copying operation.

The foregoing relationship between the slit 2 in the casing member 1 and the original setting board 4 during a copying operation will be explained in further detail. In the condition shown in FIG. 3, the center line of the original setting board 4 coincides with that of the casing member 1. It is needless to say that the slit 2 is covered by the original setting board 4 in this state.

Figure 4:
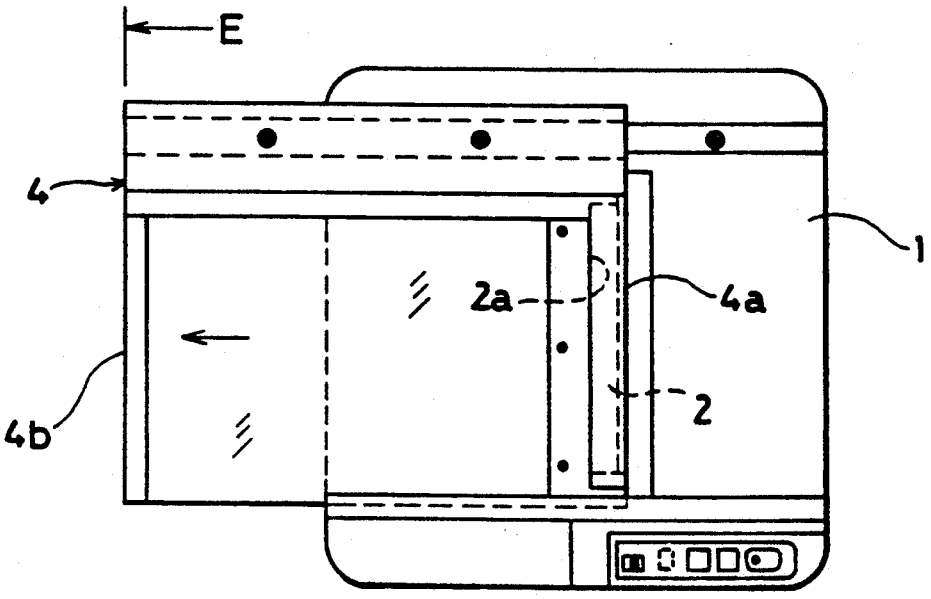

In the condition shown in FIG. 4 in which the original setting board 4 has been moved to the left end of the range E in accordance with the progress of the copying operation, the right edge 4*a* of the original setting board 4 is positioned close to the slit 2, but the slit 2 is still covered by the right edge peripheral portion of the original setting board 4.

Figure 5:
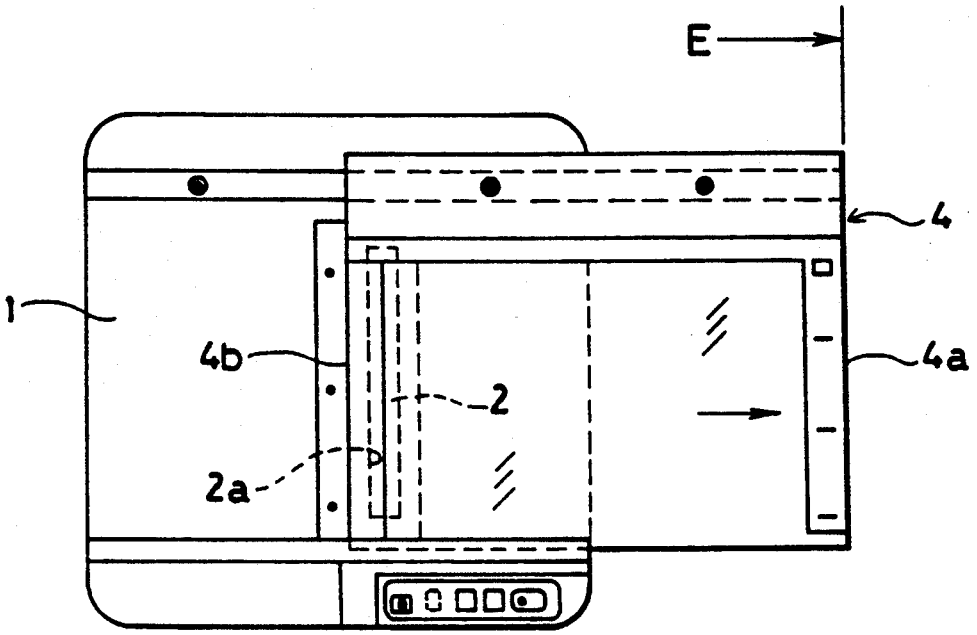

Similarly, with a further progress of the copying operation, when the original setting board 4 has moved to the right end of its moving range E, as shown in FIG. 5, a left edge 4*b* of the original setting board 4 is positioned close to the slit 2, and the slit 2 is still covered by the left edge peripheral portion of the original setting board 4.

In this way, whatever position within the moving range E the original setting board 4 may be situated at, the slit 2 in the casing member 1 is covered by the original setting board 4. Therefore, external dust, etc. can be effectively prevented from entering into the machine through the slit 2.

Figure 6:
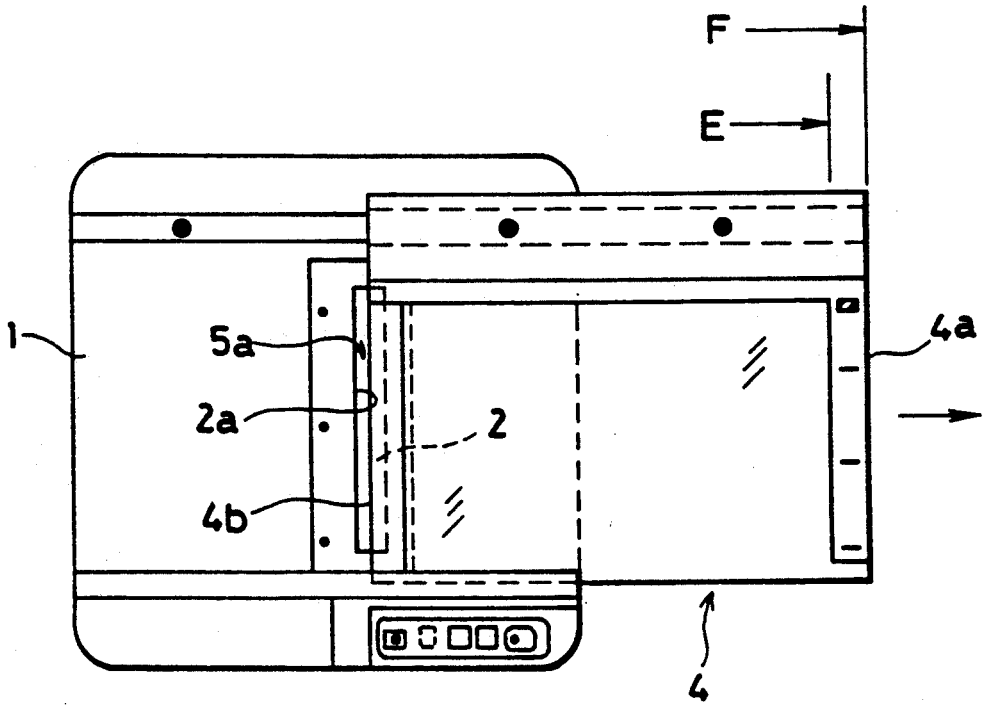

When the copying machine is not being operated, as shown in FIG. 6, the original setting board 4 moves a little further in at least one direction to the right or left, beyond the moving range E. In the present embodiment, the original setting board 4 can be moved to the right to a limit F beyond the moving range E. When the original setting board 4 is moved to the limit F as shown in FIGS. 1, 2 and 6, the width of the slit 2 and the movement limit F of the original setting board 4 are set under relative conditions so that an open gap 5*a* for a cleaner insertion passage 5 leading to the interior of the machine is defined between the left edge 4*b* of the original setting board 4 and a left edge 2*a* of the slit 2.

The left edge 4*b* of the original setting board 4 and the left edge 2*a* of the slit 2 are so formed as to serve as a guide so that they can guide a cleaner A when the cleaner A is inserted through the open gap 5*a* of the cleaner insertion passage 5 and is laterally moved.

With reference to FIG. 1, there is disposed, close to the lower part the exposure lamp 3, a reflector 6 for reflecting light projected from the exposure lamp 3 and directing the light through the slit 2 toward the original setting board 4. This reflector 6 is made of sheet metal, for example. The reflector 6, in its portion positioned on the aforementioned cleaner insertion passage 5, is provided with an opening 6*a* through which the cleaner A can be inserted. The opening 6*a* extends in the longitudinal direction of the reflector 6 as shown in FIG. 7.

Two flexible sheets 7, 8 having light shielding and light reflecting properties are placed on the reflector 6, at the upper and lower sides thereof respectively, with the aid of an adhesive agent or an adhesive double coated tape in such a way that the flexible sheets 7 and 8 are opposite to each other with a predetermined spacing in between so as to cover the opening 6*a*. The outer flexible sheet 7, or both flexible sheets 7, 8 have light reflecting properties. To explain more specifically, aluminum is deposited over the surface of the flexible sheet to provide light reflecting properties. The cleaner insertion passage 5 is shut off at its mid-point by the two flexible sheets 7, 8 so that the cleaner insertion passage 5 is shielded from light. Since the flexible sheets 7, 8 are provided with light reflecting properties, they can serve as a part of the reflector 6.

Figure 7:
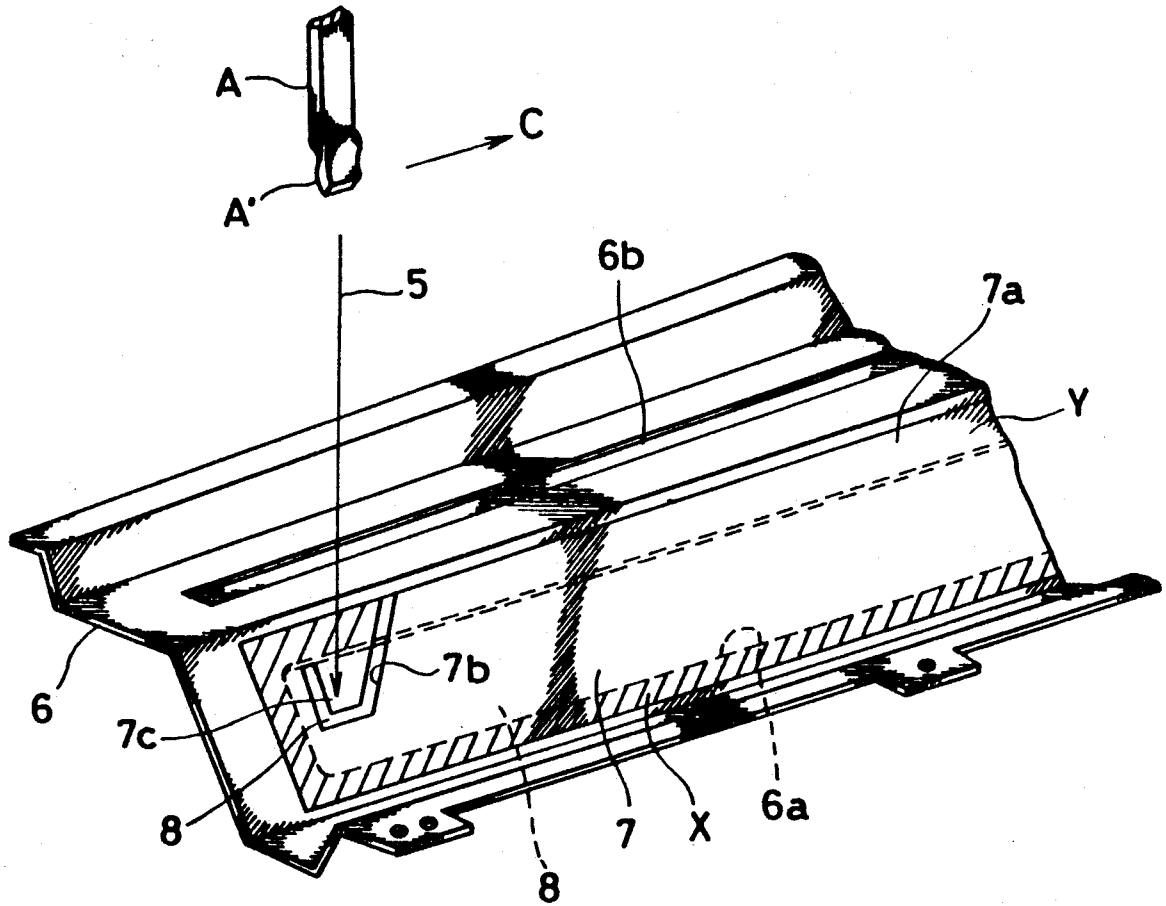
Figure 8:
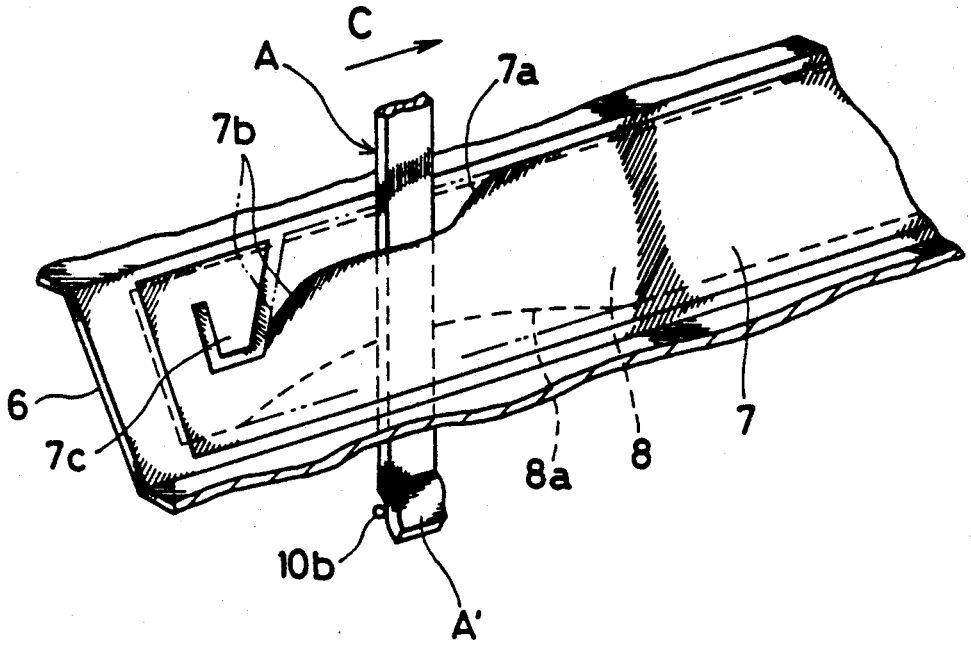

The outside flexible sheet 7 located on the cleaner insertion passage 5 is placed with adhesive on the upper side of the reflector 6 as shown in FIGS. 7 and 8. A bonded area X of the flexible sheet 7 on the reflector 6 covers the entire area of the lower end portion of the flexible sheet 7 extending along the wall portion of the reflector 6 under the opening 6*a* thereof and, as required, the side edge portions and a part of the upper edge portions adjacent thereto of the flexible sheet 7, as indicated by oblique lines in FIG. 7. The upper end portion of the flexible sheet 7 excepting the bonded area X is a non-bonded area Y. A longitudinal edge portion 7*a* of the sheet which corresponds to the non-bonded area Y is normally in close contact with the reflector 6, but as shown in FIG. 8, the longitudinal edge portion 7*a* of the sheet is separated from the reflector 6 and partially raised when the cleaner A is inserted through the opening 6*a*.

Further, the flexible sheet 7 has an inclined edge 7*b* formed by cutting a part of the sheet from its upper edge along the cleaner insertion passage 5. The edge 7*b* is upwardly inclined in the direction of post-insertion movement of the cleaner A (the direction of arrow C). The flexible sheet 7 also has a tongue 7*c* formed on the cleaner insertion passage 5. The tongue 7*c* has an inclined edge parallel to the inclined edge 7*b* and extends downwardly from the upper end of the flexible sheet 7. The cleaner insertion passage 5 is partially shut off by the tongue 7*c*. In the case that a flexible sheet 8 is disposed opposite to the flexible sheet with a predetermined spacing in between, the tongue 7*c* is not needed. Thus, when the front end portion of the cleaner A is inserted, pushing the tongue 7*c* positioned on the cleaner insertion passage 5 and then this cleaner A is laterally moved as shown in FIG. 8, the inclined edge 7*b* of the flexible sheet 7 is raised by the cleaner A. Accordingly the longitudinal sheet edge 7*a* which constitutes the non-bonded area Y of the flexible sheet 7 is caused to be partially raised toward the outer side. This permits the lateral movement of the cleaner A.

Meanwhile the inner side flexible sheet 8 disposed opposite to the flexible sheet 7 with a predetermined spacing in between is bonded to the underside of the reflector 6. In contrast with the flexible sheet 7, this flexible sheet 8 is bonded to the upper wall portion of the reflector 6 extending along the opening 6*a* thereof and a longitudinal sheet edge 8*a* of the flexible sheet 8 which is positioned at the lower wall side of the opening 6*a* is normally in close contact with the reflector 6, as shown in FIGS. 7 and 8. The longitudinal sheet edge 8*a* constitutes a non-bonded area which is separated from the reflector 6 so as to partially hang down, being deflected when a force from the cleaner A is applied. Therefore, when the front end portion of the cleaner A is pushed in and moved laterally, the longitudinal sheet edge 8*a* of the flexible sheet 8 is caused to partially hang down toward the inner side.

At a location a little away from the flexible sheets 7, 8 in the reflector 6, there is formed a slit 6*b* as shown in FIG. 1. The slit 6*b* guides the light reflected from the original on the original setting board 4 to a Selfoc lens 9 disposed under the reflector 6, after the original is exposed to light from the exposure lamp 3.

As also shown in FIG. 1, a main charger 10 is disposed under the flexible sheets 7, 8 on the cleaner insertion passage 5, and a charge wire 10*b* is placed in a main charger case 10*a* of the main charger 10. The main charger case 10*a* is provided formed with an opening 10*c* which permits the insertion and lateral movement of the cleaner A.

A photoreceptor drum 11 is rotatably disposed in the interior of the copying machine. The main charger 10 and the Selfoc lens 9 are sequentially disposed around the photoreceptor drum 11. Further, around the photoreceptor drum 11 there are disposed a developing unit 12, a copying sheet guide 13, a transfer charger 14, a separation roller 15, and a cleaning unit 16, in this order.

Secondly, the operation of the copying machine will be explained. When a copy switch is turned ON after an original is placed on the original setting board 4 and an original cover (not shown) is placed on the original, high voltage is applied to the charge wire 10*b* of the main charger 10, whereupon corona develops from the charge wire 10*b* to ionize airborn particles. The resulting ions deposit on the surface of the photoreceptor drum 11, and thus the outer periphery of the photoreceptor drum 11 is charged.

Meanwhile, the original setting board 4 goes into reciprocating movement in the right and left directions within the moving range E on the casing member 1, whereupon a part of the light projected from the exposure lamp 3 is reflected by the reflector 6 and the outer flexible sheet 7 which constitutes a part of the reflector 6, and the substantially entire quantity of the light is directed to the original on the original setting board 4 through the slit 2 of the casing member 1. The light reflected from the original slit 6*b* of the reflector reaches the Selfoc lens 9 via the 6, and the charged surface of the photoreceptor drum 11 is exposed to light through the Selfoc lens 9 to form a latent image.

A latent image formed on the photoreceptor drum 11 is developed by the developing unit 12 into a visible toner image, which is thereafter transferred as a visible image by the transfer charger 14 onto a copying sheet delivered by means of the copying sheet guide 13. Then, the copying sheet is separated by the separation roller 15 from the photoreceptor drum 11 and subsequently the visible image on the copying sheet is fixed by a fixation unit (not shown). Thereafter, the copied sheet is transferred out of the machine. Any residual toner present on the photoreceptor drum 11 is removed by the cleaning unit 16 and the static of the photoreceptor drum 11 is eliminated. Thereafter, the photoreceptor drum 11 again goes into the charge zone where the photoreceptor drum 11 is charged by the main charger 10.

When this copying operation is repeated, dust is likely to deposit on the charge wire 10*b* of the main charger 10 and the accumulated dust causes blurs and/or lines on the copied image left as they are. Therefore, it is required that the charge wire 10*b* is subjected to periodical cleaning.

For this purpose, the original setting board 4 is moved to the limit F set in one direction (in the direction of arrow B in the present embodiment) beyond the moving range E, whereby an open gap 5*a* is defined between the left edge 4*b* of the original settling board 4 and the left edge of 2*a* of the slit 2, as shown in FIGS. 1 and 6. A charger cleaning front end portion A' of the cleaner A is inserted through the open gap 5*a* of the cleaner insertion passage 5 leading inside the machine, as shown in FIG. 2.

It is noted in this connection that the position at which the charger cleaning front end portion A' of the cleaner A is inserted is predetermined. As the cleaner A is inserted into the cleaner insertion passage 5 from the predetermined position, the cleaner A is positioned and guided by both the left edge 4*b* of the original setting board 4 and the left edge 2*a* of the slit 2 of the casing member 1, and the charger cleaning front end portion A' of the cleaner A is inserted while forcing down the tongue 7*c* of the outer flexible sheet 7 bonded to the reflector 6 and causing the inner flexible sheet 8 to hang down to downstand until the charger cleaning front end portion A' comes in contact with the charge wire 10*b* of the main charger 10.

In this condition if an attempt is made to shift the cleaner A in the direction of arrow C in FIG. 8 longitudinally along the slit 2 of the casing member 1, the cleaner A abuts the inclined edge 7*b* of the outer flexible sheet 7, and if the cleaner A is further moved laterally in the direction of C, the longitudinal sheet edge 7*a* of the flexible sheet 7 is caused to be partially raised. Therefore, as shown in FIGS. 2 and 8, the outer flexible sheet 7 fixed to the reflector 6 is partially raised, while the inner flexible sheet 8 partially hangs down. Thus, by laterally moving the cleaner A while being guided by both the left edge 4*b* of the original setting board 4 and the left edge 2*a* of the slit 2, it is possible to clean the charge wire 10*b* of the main charger 10 by the cleaner A while temporarily opening the cleaner insertion passage 5 open.

By carrying out such cleaning operation through reciprocating lateral movement of the cleaner A three cycles or so, the charge wire 10*b* can be sufficiently cleaned.

To withdraw the cleaner A from the cleaner insertion passage 5, the cleaner A is reset to its original predetermined position and then pulled off. After the cleaner A is removed from the cleaner insertion passage 5, the flexible sheets 7, 8 are restored to their original flat sheet configuration by their own resiliency, and therefore, as shown in FIG. 1, the cleaner insertion passage 5 is completely shut off by the two flexible sheets 7, 8. In such a shut off condition of the cleaner insertion passage 5, there is no possibility of entry onto the photoreceptor drum 11 of stray light from an external source or from the exposure lamp 3 through the opening 6*a* of the reflector 6 formed on the cleaner insertion passage 5, nor is there possibility of leakage of light illuminated from the exposure lamp 3 through the flexible sheets 7, 8.

Figure 9:
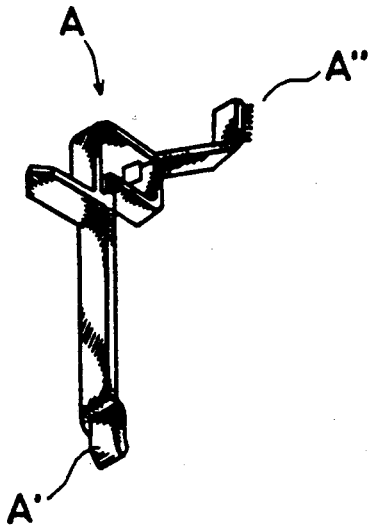

In the above described embodiment, the charger cleaning front end portion A' of the cleaner A as shown in FIG. 9 is inserted through the open gap 5*a* defined between the left edge 4*b* of the original setting board 4 and the left edge 2*a* of the slit 2 to clean the charge wire 10*b* of the main charger 10; but it is also possible to clean the exposure lamp 3, for example, by using the same cleaner A.

In this case, if an exposure lamp cleaning front end portion A" of the cleaner A as shown in FIG. 9 is inserted through the open gap 5*a*, a brush portion formed at the exposure lamp cleaning front end portion A" comes into slidable contact with the outer periphery of the exposure lamp 3. Thus, by laterally moving the cleaner A in the same way as described above, it is possible to clean the exposure lamp 3. In the lateral movement of the cleaner A in this case as well, both the left edge 4*b* of the original setting board 4 and the left edge 2*a* of the slit 2 function as a guide for the cleaner A when it is moved.

Interior components to be cleaned by the cleaner A through the utilization of the open gap 5*a* between the left edge 4*b* of the original setting board 4 and the left edge 2*a* of the slit 2 are not limited to the charge wire 10*b* of the main charger 10, but they may be, for example, the exposure lamp 3 and/or any other interior components.

Secondly, another embodiment of the invention will be described with reference to FIGS. 10 and 11. It is noted that components having the same functions as those in the foregoing embodiment are indicated by the same reference numerals or characters and the description of those components are omitted hereinafter.

A reflector 6 has an outer side flexible sheet 7 bonded thereto in such a way as to cover an opening 6*a* of the reflector 6 formed on a cleaner insertion passage 5. The flexible sheet 7 has light reflecting properties and is so constructed as to concurrently serve as a part of the reflector 6. The mounting arrangement of the flexible sheet 7 relative to the reflector 6 is the same as that described in the embodiment 1, and concretely it is as shown in FIG. 1.

Figure 10:
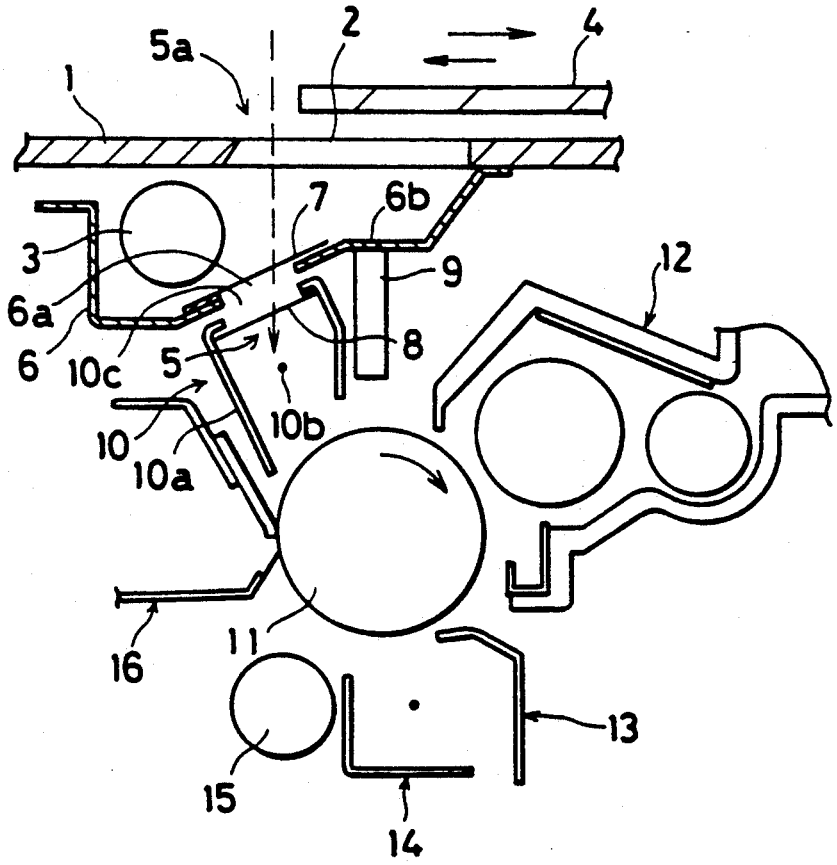
FIGS. 10 and 11 illustrate another embodiment of the invention.

An inner flexible sheet 8 disposed opposite to the flexible sheet 7 shown in FIG. 10, mounted in such a way with as predetermined space in between as to cover an opening 10*c* of a main charger case 10*a* for a main charger 10 from inside. This flexible sheet 8 has both light shielding properties and electroconductive properties and is so constructed as to concurrently serve as a part of the main charger case 10*a*. The mounting arrangement of the flexible sheet 8 is the same as that described in the embodiment 1 wherein it is mounted to the underside of the reflector 6.

Figure 11:
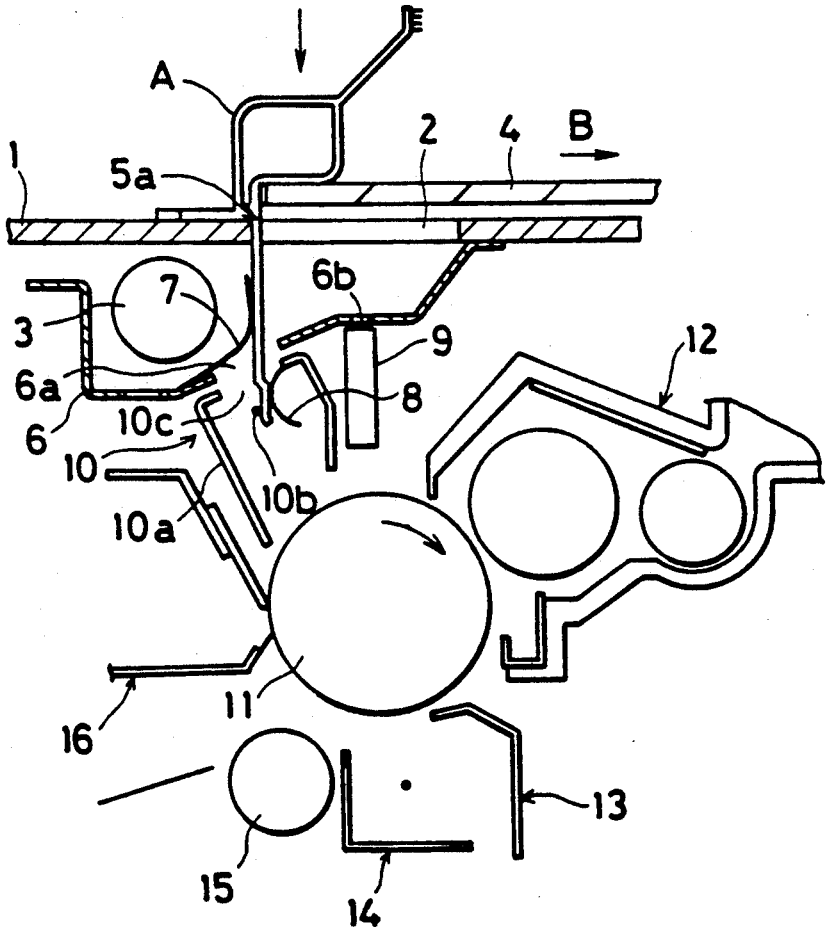

Accordingly, when the front end portion of the cleaner A is inserted into the cleaner insertion passage 5 through the open gap 5*a* defined between the casing member 1 and the original setting board 4 and is moved in lateral directions, as shown in FIG. 11, a longitudinal sheet edge 7*a* of the outer flexible sheet 7 is raised at the inner side the reflector 6, while a longitudinal sheet edge 8*a* of the inner flexible sheet 8 hangs down at the inner side of the main charger case 10*a* of the main charger 10. Thus, the cleaner insertion passage 5 is temporarily opened.

According to this embodiment, the gap between the reflector 6 and the main charger 10 can be minimized, and at the same time a part of the components can be replaced by lightweight flexible sheets 7, 8. Thus, it is possible to further facilitate size reduction. weight reduction, and reduction of the production cost.

In the above described embodiment, the cleaner insertion passage 5 is located within a space extending from the open gap 5*a* defined between the casing member 1 and the original setting board 4 to the charge wire 10*b* of the main charge 10 via the reflector 6; but the location of the cleaner insertion passage 5 is not limited to that described in this embodiment. That is, it can be arranged that flexible sheets 7, 8 having light shielding properties which can shut off the cleaner insertion passage 5 are disposed between the wall portions of the components which may interfere with cleaning operation when the cleaner A is inserted for cleaning members or other wall portions. so as to permit cleaning operation while the flexible sheets 7, 8 are temporarily held open only when the cleaner A is inserted to clean the components. Through this arrangement, the possibility of entry of stray light and the like onto the photoreceptor drum 11, which may be involved in the formation of such cleaner insertion passage 5, can be eliminated, and furthermore it is possible to perform effective cleaning of the desired components only by inserting the cleaner A from outside into the cleaner insertion passage 5 and moving the cleaner laterally.

In the above embodiment, two flexible sheets 7, 8 having light shielding properties are individually disposed at the outer side and at the inner side on the cleaner insertion passage 5 in the machine, in such a way that the flexible sheets 7 and 8 are opposite to each other, with a predetermined spacing in between, so that the cleaner insertion passage 5 is shut off; but when light shielding effect on the cleaner insertion passage 5 can be sufficiently obtained, only one flexible sheet may be provided instead of two. However, in order to ensure sufficient light shielding effect on the cleaner insertion passage 5, it is preferable that at least two flexible sheets 7, 8 are provided on the cleaner insertion passage 5. By virtue of such an arrangement, it is possible to positively avoid the possibilities of leakage of light from the exposure lamp 3 through the flexible sheets 7, 8 and/or entry of stray light and the like onto the photoreceptor drum 11 through the opening 6*a* of the reflector 6 formed on the cleaner insertion passage 5. It is to be understood that all these arrangements are included in the subject matter of the present invention.

As described above, the copying machine of the invention is: a copying machine having a casing member forming a top wall of the machine, the casing member being formed with a slit for directing the light from an exposure lamp toward an original setting board, the exposure lamp being disposed under the casing member, the original setting board being movable on the casing member for reciprocation in the right and left directions, characterized in that the copying-purpose movable range of the original setting board is defined so that the slit is covered by the original setting board irrespective of the position of the original setting board during its reciprocating movement on the casing member for copying operation, and in that the original setting board is movable beyond its copying-purpose movable range and at least in one direction, either rightward or leftward, when it is not in copying operation, the limit for the movement in one direction of the original setting board being set so that an open gap is defined between an edge of the original setting board and an edge of the slit to provide a passage for cleaner insertion which leads to the interior of the machine, when the original setting board is moved to the limit beyond the moving movable range. The edge of the original setting board and the edge of the slit are so formed as to serve as a guide for the cleaner during cleaner operation.

Through this arrangement, dust and the like can be prevented from entering into the interior of the machine through the slit of the casing member during copying operation or the like. In addition, when interior components are to be cleaned, the cleaner is inserted from outside through the open gap of the cleaner insertion passage and the interior components can be cleaned by simply externally operating the cleaner. In this way, the arrangement permits direct cleaning of the interior components through external control, and therefore, the number of components can be considerably decreased, making it possible to achieve size reduction, weight reduction, and reduction of the production cost. In addition, smooth cleaning performance and improved cleaning efficiency can be assured.

In the copying machine of the invention, there is provided, on the cleaner insertion passage accessible from outside the machine, a flexible sheet having light shielding properties in such a way as to shut off the passage. With this arrangement, it is possible to clean the interior components simply by inserting the cleaner from outside into the cleaner insertion passage and externally operating the cleaner, which naturally results in considerable improvement in cleaner operation and cleaning efficiently. In addition, the arrangement prevents stray light et cetera from an external light source or the exposure lamp from falling onto the photoreceptor drum within the machine through the cleaner insertion passage, thereby permitting to maintain excellent copying performance. In addition, the arrangement permits size reduction, weight reduction, and reduction of the production cost.

In the copying machine of the invention, flexible sheets are individually disposed at the outer side and at the inner side on the cleaner insertion passage leading to the interior of the machine in such a way as to shut off the passage, and are opposite to each other with a predetermined spacing in between. With this arrangement, in addition to the above mentioned advantages, it is possible to positively eliminate leakage of light from the exposure lamp passing through the flexible sheets, and stray light and the like from an external light source et cetera onto the photoreceptor drum.

Also, in the copying machine of the invention, the flexible sheet disposed at the outer side has light reflecting properties so that it concurrently serves as a part of a reflector. The flexible sheet disposed at the inner side has electroconductive properties so that it concurrently serves as a part of a main charger case. Through this arrangement, in addition to the above described advantages it is possible to obtain increased flexibility of design with respect to copying machines, and also to minimize the gap between the reflector and the main charger, to thereby further facilitate size reduction, weight reduction, and reduction of the production cost.

Furthermore, in the copying machine of the present invention, the flexible sheet disposed at the outer side is formed with a inclined edge portion along a flexible sheet portion where the cleaner is inserted so as to enable a longitudinally extending edge portion of the sheet to rise outwardly of the machine as the inserted cleaner portion moves in lateral directions, while on the other hand the flexible sheet disposed at the inner side has a longitudinally extending portion adapted to hang down inwardly of the machine as the inserted cleaner portion moves in lateral directions. Through the above described arrangement, in addition to the already described advantages, the cleaning operation of the interior components can be smoothly performed by the cleaner without plastic deformation of the flexible sheets.

What is claimed is:

1. A copying machine comprising:

a photoreceptor;

a top wall;

a board for setting thereon an original to be copied;

an exposure lamp;

copying means for directing light emitted from said exposure lamp and reflected by an original on said board onto said photoreceptor to form a latent image on said photoreceptor while causing said board to slidingly move over said top wall in a first direction;

said top wall having formed therethrough a slit which is elongated in a second direction transverse to said first direction, a passage being formed under said top wall and a cleaner member inserted therethrough from said slit to a component which requires cleaning and movable in said second direction within said passage;

a main reflector disposed in said passage, said main reflector having formed therethrough an opening which is elongated so as to allow said cleaner member inserted downward through said passage both to pass through said opening and to be moved in said second direction; and at least one movable sub-reflector normally positioned so as to cover said opening so as to close said passage and to prevent light from passing through said passage to reach said photoreceptor, said sub-reflector being elastic and allowing said cleaner member to be inserted through and be moved inside said opening.

2. The copying machine of claim 1 wherein said component that requires cleaning includes a charging wire extended in said second direction inside a charger case which is disposed in said passage.

3. The copying machine of claim 1 wherein said at least one sub-reflector includes a first flexible sheet and a second flexible sheet, said first and second sheets being separated by a predetermined distance with respect to and opposite to each other and being attached on opposite sides of said main reflector.

4. The copying machine of claim 2 wherein said at least one sub-reflector includes a first sheet and a second sheet, said first and second sheets being separated by a predetermined distance with respect to and opposite to each other and being attached on opposite sides of said main reflector.

5. The copying machine of claim 3 wherein said first sheet has a shielding area which serves to close said passage, said sheets each having two longitudinal edges, said first sheet having a hook-shaped tongue-like part, said tongue-like part serving to be pushed down when said cleaner member is inserted through said passage, said longitudinal edges not being fastened to said main reflector around said main reflector opening but serving to separate from said main reflector as said cleaner member is inserted through said tongue-like part and moved inside said passage in said second direction and to elastically return to a sheet-like form and to close said main reflector opening by coming to tightly contact said main reflector after said cleaner member has passed.

6. The copying machine of claim 4 wherein said first sheet has a shielding area which serves to close said passage, said sheets each having two longitudinal edges, said first sheet having a hook-shaped tongue-like part, said tongue-like part serving to be pushed down when said cleaner member is inserted through said passage, said longitudinal edges not being fastened to said main reflector around said main reflector opening but serving to separate from said main reflector as said cleaner member is inserted through said tongue-like part and moved inside said passage in said second direction and to elastically return to a sheet-like form and to close said main reflector opening by coming to tightly contact said reflector after said cleaner member has passed.

7. The copying machine of claim 5 wherein said first flexible sheet has a light-reflective surface opposite said exposure lamp.

8. The copying machine of claim 6 wherein said first flexible sheet has a light-reflective surface opposite said exposure lamp.

9. The copying machine of claim 7 wherein said light-reflective surface of said first flexible sheet has vapor deposited aluminum.

10. The copying machine of claim 8 wherein said light-reflective surface of said first flexible sheet has vapor deposited aluminum.

11. The copying machine of claim 2 wherein said charger case has a charger opening covered with a flexible, elastic, light-shielding and electroconductive sheet having two longitudinal edges, one of said two longitudinal edges being firmly attached to said charger case along said charger opening, the other of said two longitudinal edges not being firmly attached to said charger case but being separated from said charger case along said charger opening by said cleaner member inserted through said passage and moved within said passage in said second direction and to elastically return to a sheet-like form and to close said charger opening by coming to tightly contact said charger case along said charger opening after said cleaner member has passed.

12. The copying machine of claim 1, wherein the board is movable with respect to the top wall only within a predetermined range in the first direction during a copying operation of the copying machine, the predetermined range being such that the slit is always covered by the board when the board is within the predetermined range with respect to the top wall, the board being movable beyond the range with respect to the top wall when the copying machine is not in a copying operation so as to uncover the slit, the board having an edge extending in the second direction, the edge of the board and an edge of the slit serving to guide the cleaner member in a motion inside the passage along the second direction.

13. The copying machine of claim 12, wherein the component which requires cleaning includes a charging wire extended in the second direction inside a charger case which charger case is disposed in the passage.

* * * * *